US006609668B1

(12) United States Patent
Rhodd

(10) Patent No.: US 6,609,668 B1
(45) Date of Patent: Aug. 26, 2003

(54) CAVITATION AND CLEANING TOOL

(75) Inventor: Clint Rhodd, Gillette, WY (US)

(73) Assignee: Cavitation, Inc., Gillette, WY (US)

( * ) Notice: Subject to any disclaimer, the term of this patent is extended or adjusted under 35 U.S.C. 154(b) by 0 days.

(21) Appl. No.: 09/773,267

(22) Filed: Jan. 30, 2001

(51) Int. Cl.[7] ..... B05B 1/14; B05B 3/00; B05B 7/08; A02C 2/08

(52) U.S. Cl. ..... 239/559; 239/548; 239/549; 239/225.1

(58) Field of Search ..... 239/548, 549, 239/550, 553.3, 553.5, 225.1, 266, 251, 380, 381, 559; 166/170–173, 175, 311; 134/167 R, 168 R

(56) References Cited

U.S. PATENT DOCUMENTS 3,583,489 A * 6/1971 Hutchison et al. ..... 166/312
3,824,646 A * 7/1974 Jai ..... 15/104.1
4,088,191 A * 5/1978 Hutchison ..... 166/223
4,185,690 A * 1/1980 Kinney ..... 166/133
4,612,986 A * 9/1986 Fosdick, Jr. et al. ..... 166/171
4,799,554 A * 1/1989 Clapp et al. ..... 166/312
4,919,204 A * 4/1990 Baker et al. ..... 166/223
5,052,423 A * 10/1991 Chapman et al. ..... 134/174
5,564,500 A * 10/1996 Rogers et al. ..... 166/312
6,148,932 A * 11/2000 Argillier et al. ..... 175/65
6,302,201 B1 * 10/2001 Elliott ..... 166/173

* cited by examiner

*Primary Examiner*—Davis Hwu
(74) *Attorney, Agent, or Firm*—Sierra Patent Group, Ltd.

(57) ABSTRACT

An integrated cavitation and cleaning tool is provided with a plurality of ports for jetting out a combination of air, water and drilling foam pumped into a coal well using air compressor and a water pump to force the combined air, water and drilling form through the cleaning tool out of each of the plurality of ports while the cleaning tool is rotationally maintained to clean and flush out old coal wells not in production.

20 Claims, 8 Drawing Sheets

CAVITATION AND CLEANING TOOL

BACKGROUND OF THE INVENTION

1. Field of the Invention

The present invention relates to cleaning tools for wells. More particularly, the present invention relates to method and apparatus for providing cavitation and cleaning tool for wells in coal bed methane industry.

2. Description of the Related Art

In coal mining industry, a device called an under-reamer is used to clean and flush out old coal mining wells that are not in active production. Generally, the wells are opened from 6 to 24 inches in diameter and the under-reamer is used for completion and work-over type operation. Once the wells are cleaned and flushed out, they can be put back in the production line. The under-reamer is approximately 36 inches in length, and has a 4-inch body with several 5-inch blades that are configured to protrude away from the body with applied air pressure.

FIGS. 1A–1C illustrate an under-reamer 100 for cleaning and flushing out coal mining wells available from Baker Hughes Tool Company. As can be seen, in FIG. 1A, the under-reamer 100 is shown with three blades 110 (third not shown) in a closed position, while in FIG. 1B, the blades 110 are shown in an open position. Moreover, it can be seen from FIG. 1C that a drill bit 50 can be connected to the end of the under-reamer 100 depending upon drilling needs and requirements.

In operation, the under-reamer 100 is tripped in the hole within the well with a 6¼ inch bit drill to drill out the cement and the shoe, where the shoe refers to the bottom portion of the casing outlining the inner walls of the well. For example, the casing may be set at one thousand feet in which case, the shoe of the casing would be at one thousand feet depth. Then, cement is forced down the inside of the casing which, in turn, forces the cement up a back side of the casing to extract the cement to the surface of the well. This is generally performed in order to comply with the governmental regulations for the protection of the shallow water sands.

For a coal section of 1,000 feet by 1,000 feet, the section from 1,000 feet to 1,150 feet is drilled out which includes the drilling of a 50 feet rat hole beneath the desired coal section, thus resulting in a total depth of 1,150 feet. Then Gam-Ray log is performed to determine the location of the best coal production after the trip out of the hole. Thereafter, the under-reamer is run to open the hole below the 7-inch casing from 7 to 10 inches from 1,001 feet to 1,100 feet. Then the 10-inch under-reamer is tripped out of the hole and a 14-inch under-reamer is used to open the hole to 14 inches. Having opened the hole to 14 inches, the 14-inch under-reamer is tripped out and a 6¼ inch bit is used to trip in the hole, and blows and clean the well with air and drilling foam.

The operation described above may take three to seven days, since in using the bit, the air and drilling foam is jetted straight up and down in a substantially straight line perpendicular to the surface. Furthermore, in using the under-reamer as described above, the excess fine coal tends to get trapped n the cavity of the well bore, and thus the fine coal tends to stay in the well.

More significantly, during the operation of the under-reamer, when air pressure is removed, there are occasions when the two blades do not close. For example, in running the under-reamer through the inside of a 7-inch casing, the 5-inch blades, which, with the applied pressure open to 14 inches, may collect unwanted physical objects behind the blades such that when the applied pressure is removed, the blades do not properly close, requiring approximately two to three hours devoted solely to close the blades on the under-reamer. At a rig time cost of $210 per hour, the extra two to three hours would add an additional cost of $420 to $630.

While the precise cost involved in using an under-reamer may vary depending on the condition of the well as well as other factors, as an illustration, the total cost would include a half-hour trip into the well at $105.00 of rig time, $175.00 for the cost of the under-reamer itself, one hour of rig time at $210/hour, a half-hour trip out cost at $105.00 and a cost for trip in with a bit at $105, totaling to $700.00. Furthermore, if the blades of the under-reamer do not close as discussed above, a substantial amount of time must be devoted to get the blades closed.

SUMMARY OF THE INVENTION

In view of the foregoing, in accordance with the present invention, there is provided a cavitation and cleaning tool and a corresponding method of providing the same without any blades and which is configured to open holes in the well of 20 to 24 inches in diameter. Using air and injecting ten gallons of water per minute with one quart of liquid drilling form every 30 minutes, the cavitation and cleaning tool of the present invention is configured to perform a cutting action with the pumped air and water, while the liquid drilling foam acts as a lifting agent for lifting the coal out of the hole. In this manner, the fine coal is maintained in a turbulent motion and the well is cleaned out in a significantly improved manner as compared to using a conventional under-reamer running a bit with a straight up and down circulation motion.

A cavitation and cleaning tool in accordance with one embodiment of the present invention includes an elongated body having a first end, a second end and an outer surface, a hollow channel running between said first and second ends defining an inner surface of said body, said body including a plurality of ports positioned at a predetermined distance from each other on said body, each of said ports connected to said hollow channel, wherein when pressure is applied at said first end of said body in said channel, each of said ports configured to pass the content of said channel through said each port in a radial direction substantially perpendicular to said outer surface of said body.

In one aspect of the present invention, the body and the hollow channel are substantially cylindrically shaped, where the channel defines a substantially circular openings at the respective first and second ends of the body, each of the substantially circular openings having a diameter of approximately 4.5 inches. Furthermore, each of the ports has a substantially cylindrical port channel each connected to the hollow channel of the body for passing the content therethrough, where the port channel each has approximately a one-inch diameter. Moreover, each of the plurality of ports is positioned substantially equidistant from each other at approximately a 90 degree angle.

Furthermore, in accordance with one aspect of the present invention, a predetermined portion of the inner surface of the body at the first and second ends are each threaded, where the threaded predetermined portions are 3½ inches each in length along the length of the inner surface of said body. Furthermore, the content passed through the hollow channel of the body and each port channels includes a combination of water, air and drilling foam, where when the pressure is applied at the first end of the body in the channel, the body is configured to rotate while passing the content of the channel through each of the plurality of ports.

A method of providing a cavitation and cleaning tool in accordance with another embodiment of the present invention includes the steps of providing an elongated body having a first end, a second end and an outer surface, a hollow channel running between said first and second ends defining an inner surface of said body; providing a plurality of ports at a predetermined distance from each other on said body, each of said ports connected to said hollow channel; and applying a pressure at said first end of said body in said channel to pass the content of said channel through said each port in a radial direction substantially perpendicular to said outer surface of said body. Moreover, in accordance with the present invention, the method of providing the cavitation and cleaning tool may further include the steps of rotating said body and passing the content of said channel through each of said plurality of ports.

These and other features and advantages of the present invention will be understood upon consideration of the following detailed description of the invention and the accompanying drawings.

DETAILED DESCRIPTION

Figure 1A:
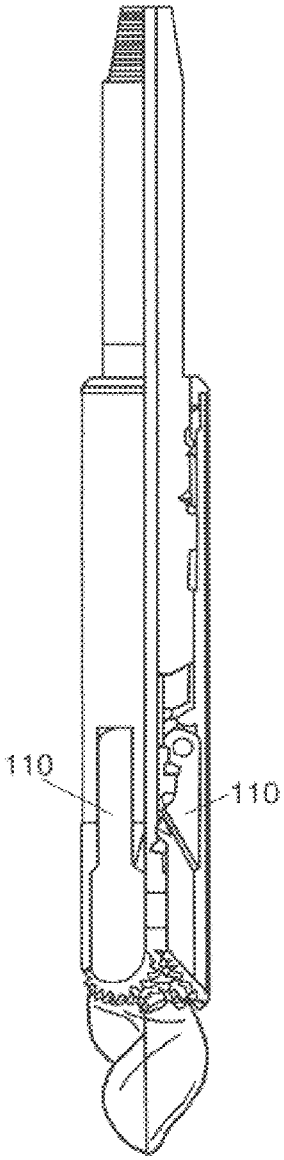
FIG. 1A PRIOR ART
FIGS. 1A–1C illustrate an under-reamer for cleaning and flushing out coal mining wells.
Figure 1B:
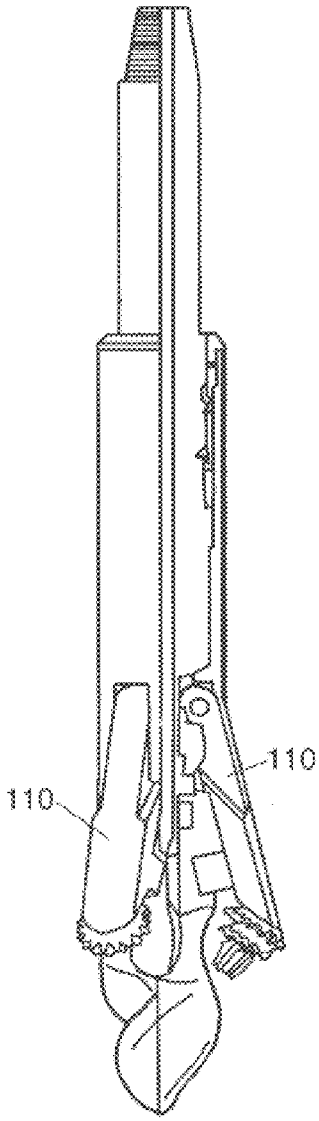
FIG. 1B PRIOR ART
Figure 1C:
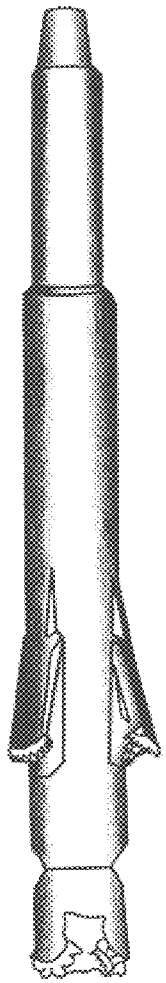
FIG. 1C PRIOR ART
Figure 2:
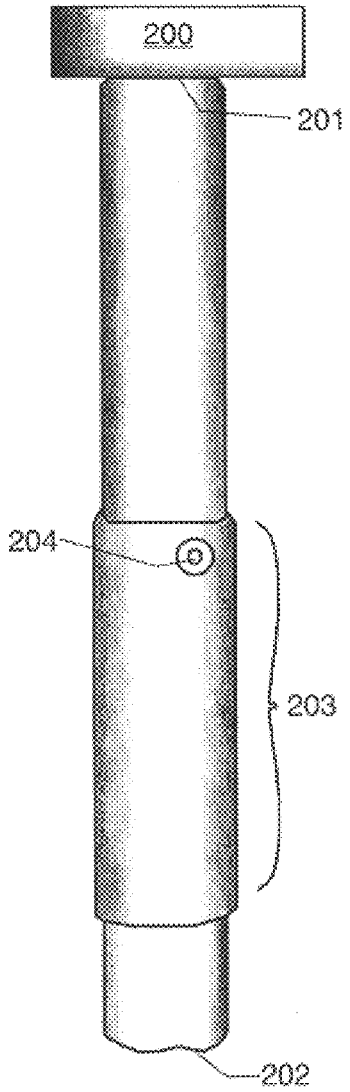
FIG. 2 illustrates a front view of a cavitation and cleaning tool in accordance with one embodiment of the present invention.

FIG. 2 illustrates a front view of a cavitation and cleaning tool in accordance with one embodiment of the present invention. As shown, the cavitation and cleaning tool 200 is shaped in an elongated cylindrical fashion and substantially hollow inside. As will be discussed in further detail below, the cleaning tool 200 has a top end 201 and a bottom end 202. The top end 201 of the cleaning tool 200 is configured to be connected to pipe (not shown), which then provides a combination of air, water and drilling foam down through the hollow body of the cleaning tool 200. Furthermore, the bottom end 202 is configured to be optionally connected to a bit (not shown) such as that used in the conventional under-reamer.

In one aspect of the present invention, the inner surfaces of the top end 201 and the bottom end 202 of the cleaning tool 200 are threaded such that the top end 201 can be connected to a likewise threaded pipe for a secure connection while the bottom end 202 can be connected to a likewise threaded bit.

Moreover, as shown in FIG. 2, the cleaning tool 200 is provided with a port section 203 which is positioned closer to the bottom end 201 of the cleaning tool 200. The port section 203 is provided with a plurality of jet ports 204 each of which jet out material that are pumped into the cleaning tool 200 from the top end 201. For example, in one aspect of the invention, the each jet port 204 is positioned at a substantially 90 degree angle from each other. In other words, as will be discussed in further detail below, the jet ports 204 are positioned on the cleaning tool 200 such that with a rotational movement of the cleaning tool 200, the outflow from each jet port 204 can be substantially even.

Figure 3:
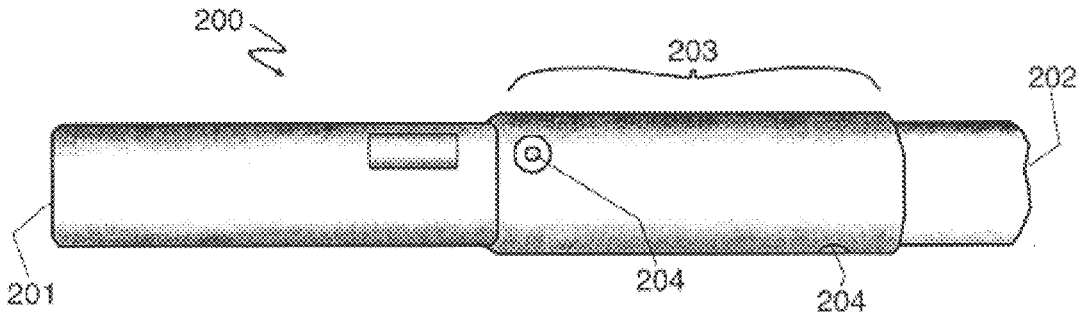
FIG. 3 illustrates a side perspective view of the cavitation and cleaning tool 200 of FIG. 2 in accordance with one embodiment of the present invention.
Figure 4:
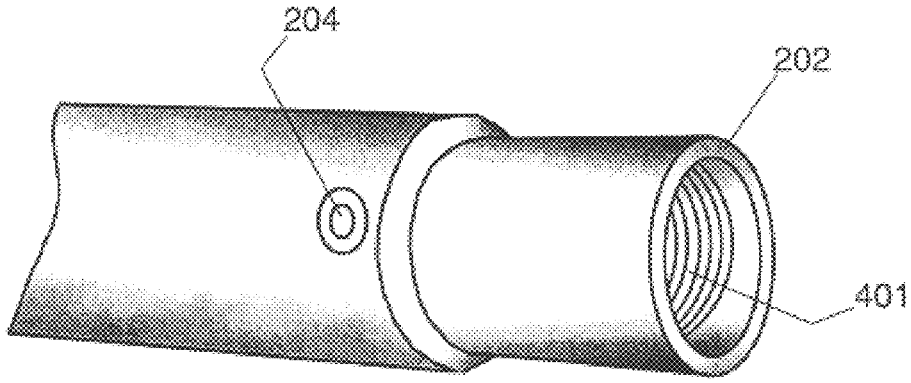
FIG. 4 illustrates a perspective view of the bottom end 202 of the cavitation and cleaning tool 200 of FIG. 2 in accordance with one embodiment of the present invention.

FIG. 3 illustrates a side perspective view of the cavitation and cleaning tool 200 of FIG. 2 in accordance with one embodiment of the present invention. In FIG. 3, at least two jet ports 204 are shown within the port section 203 of the cleaning tool 200. FIG. 4 illustrates a perspective view of the bottom end 202 of the cavitation and cleaning tool 200 of FIG. 2 in accordance with one embodiment of the present invention. As can be seen, the inner surface 401 of the bottom end 202 of the cleaning tool 200 is threaded such that a likewise threaded bit piece (not shown) can be optionally attached securely to the bottom end 202 of the cleaning too 200. In one aspect of the invention, a 6¼ inch regular having a pin with 3½ inch thread can be connected to the bottom end 202 of the cleaning tool 200.

Figure 5:
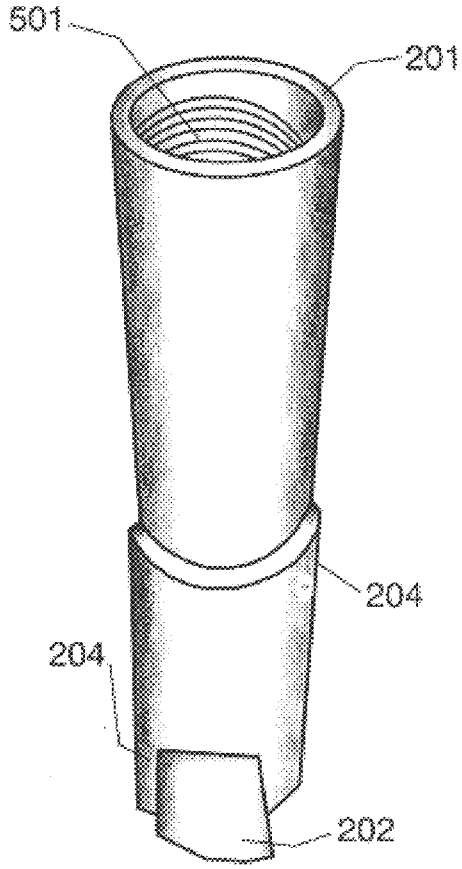
FIG. 5 illustrates a perspective view of the top end 201 of the cavitation and cleaning tool 200 of FIG. 2 in accordance with one embodiment of the present invention.

FIG. 5 illustrates a perspective view of the top end 201 of the cavitation and cleaning tool 200 of FIG. 2 in accordance with one embodiment of the present invention. Similar to the bottom end 202 of the cleaning tool 200 as discussed in conjunction with FIG. 4, as can be seen from FIG. 5, the inner surface 501 of the top end 201 of the cleaning tool 200 is threaded so that a likewise threaded pipe (not shown) can be securely attached to the top end 201 of the cleaning tool 200. Once securely connected, a combination of air, water and drilling foam and be pumped into the cleaning tool 200 via the pipe for outflow through the bottom end 202 and the jet ports 204.

Figure 6:
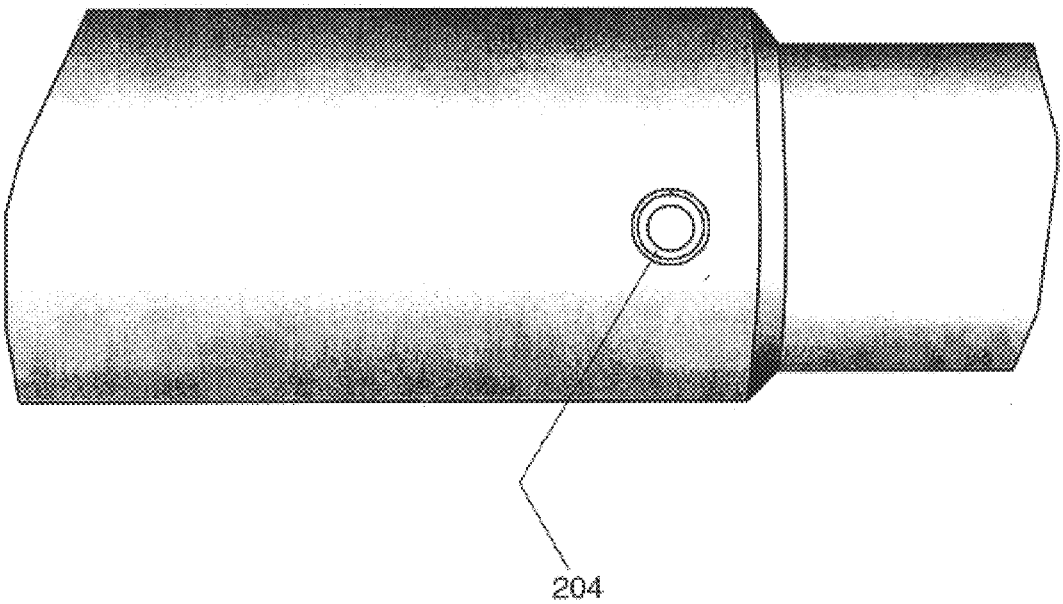
FIG. 6 illustrates a close-up view of one of a plurality of jet ports 200 positioned at the port section 203 of the cavitation and cleaning tool 200 of FIG. 2 in accordance with one embodiment of the present invention.

FIG. 6 illustrates a close-up view of one of the plurality of jet ports 204 positioned at the port section 203 of the cavitation and cleaning tool 200 of FIG. 2 in accordance with one embodiment of the present invention. As shown, the jetport 204 is substantially circular in shape, and in one aspect of the present invention, has a one inch diameter. Moreover, it can be seen from FIG. 6 that the jet port 204 connects to the inner hollow of the cleaning tool 200 such that material input from the top end 201 of the cleaning tool 200, when pumped down the body of the cleaning tool 200, will flow out of the jetport 204. Furthermore, it can be seen that the port section 203 of the cleaning tool 200 is substantially beveled out at either end of the cleaning tool 200 such that the total outer circumference of the port section 203 is greater than the total outer circumference of the remaining portions of the cleaning tool 200.

Figure 7:
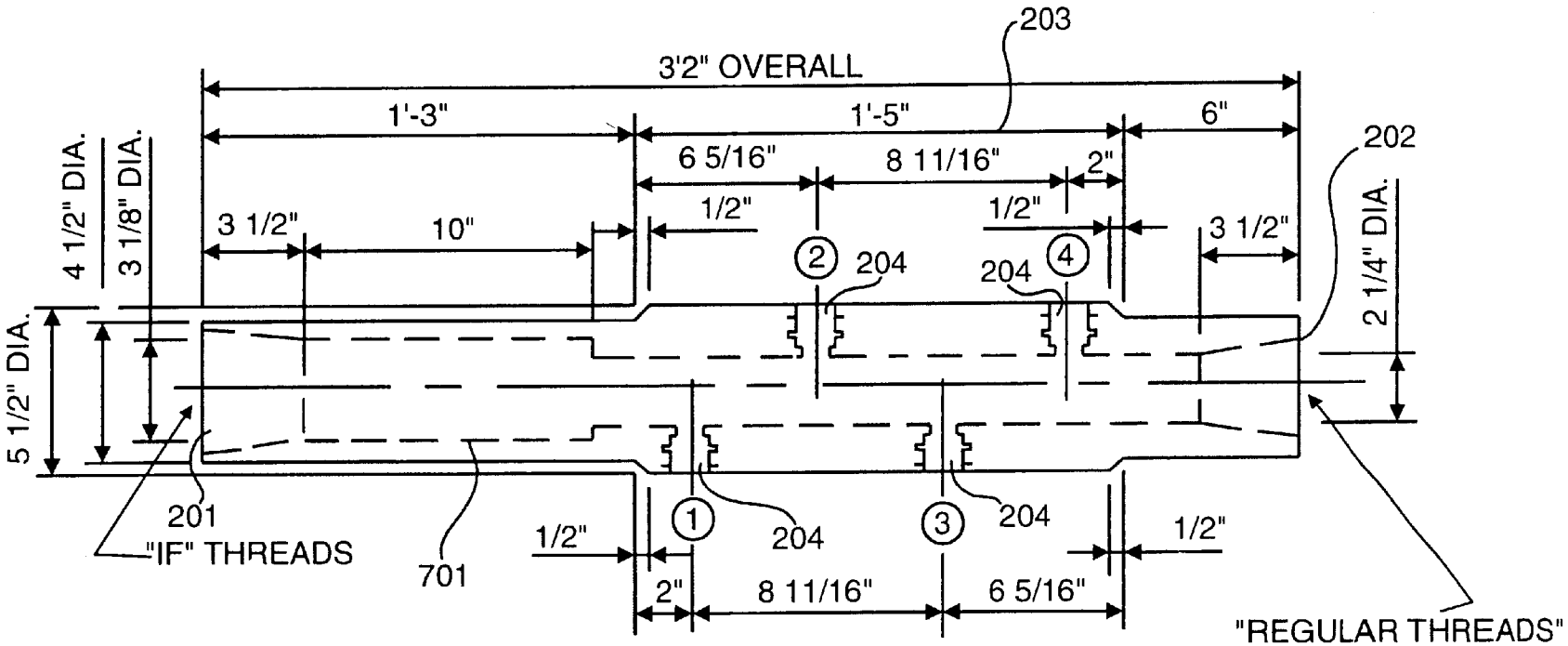
FIG. 7 illustrates a cross-sectional view of the cavitation and cleaning tool 200 of FIG. 2 in accordance with one embodiment of the present invention.

FIG. 7 illustrates a cross-sectional view of the cavitation and cleaning tool 200 of FIG. 2 in accordance with one embodiment of the present invention. As shown, in one aspect of the present invention, the cleaning tool 200 is 3 feet 2 inches overall from the top end 201 to the bottom end 202. The port section 203 in this embodiment is provided at one foot 5 inches in length along the length of the cleaning tool 200, including the beveled outer sections on either end of the port section 203 of the body of the cleaning tool 200.

Furthermore, it can be seen that the plurality of jet ports 204 are positioned substantially in a staggered manner within the port section 203 of the cleaning tool 200, each jet port 204 being connected to the inner hollow of the cleaning tool 200 such that, as previously discussed, any input flow into the top end 201 of the cleaning tool 200 will result in the same material flowing out of each of the jet ports 204. The dotted line 701 shown in FIG. 7 illustrates the boundary for the inner hollow of the cleaning tool 200. In particular, it can be seen that the diameter of the opening at the top end 201 of the cleaning tool 201 in one aspect of the present invention is approximately 3⅛ inches, while that of the bottom end 202 is approximately 2¼ inches. Moreover, it can be seen from FIG. 7 that the jet ports 204 are distanced at approximately 8 11/16 inches apart from each other along a cross-sectional portion of the port section 203.

Figure 8:
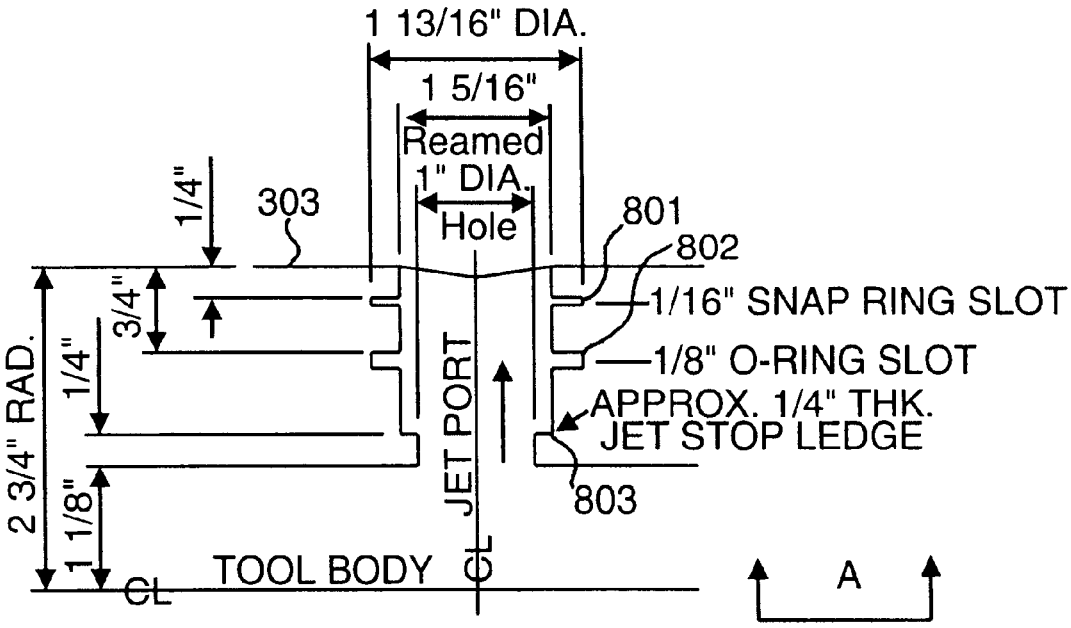
FIG. 8 illustrates a cross-sectional view of one of the plurality of jet ports 204 of the cavitation and cleaning tool 200 of FIG. 2 in accordance with one embodiment of the present invention.

FIG. 8 illustrates a cross-sectional view of one of the plurality of jet ports 204 of the cavitation and cleaning tool 200 of FIG. 2 in accordance with one embodiment of the present invention. As shown, the opening of the jet port 204 is approximately one inch in diameter, with the thickness of the jet port 204 being approximately 5/16th of one inch. Moreover, along the other circumference of each jet port 204, there are provided a 1/16th inch snap ring slot 801, a ⅛th inch O-ring slot 802, and a jet port ledge 803, each of which will be discussed in further detail below. In particular, it can be seen from FIG. 8 that the snap ring slot 801 is circumferentially positioned at approximately ¼th inch from the side surface of the port section 203 of the cleaning tool 200, while the O-ring slot 802 is circumferentially positioned at approximately ¾th inch from the side surface of the port section 203 of the cleaning tool 200. Furthermore, the jet port ledge 803 is provided within the jet port 204 to protrude inwards from the side walls of the jet port 204 to position a jet module inserted into the jet port 204.

Figure 9:
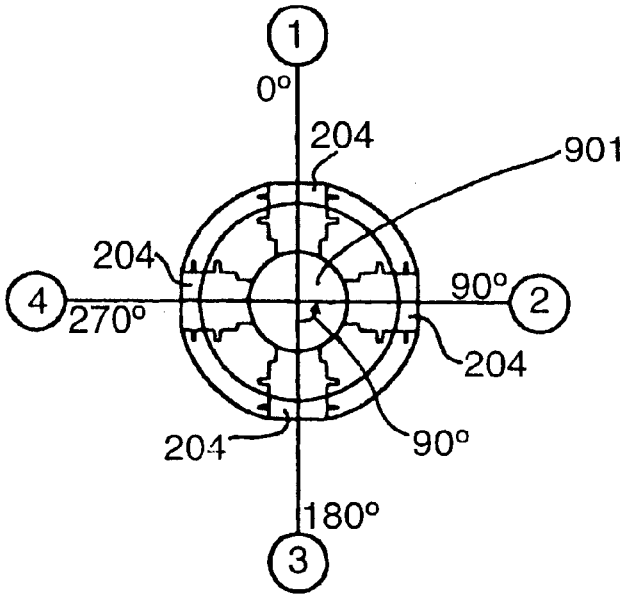
FIG. 9 illustrates an end view of bottom end 202 of the cavitation and cleaning tool 200 of FIG. 2 in accordance with one embodiment of the present invention.

FIG. 9 illustrates an end view of the bottom end 202 of the cavitation and cleaning tool 200 of FIG. 2 in accordance with one embodiment of the present invention. In particular, FIG. 9 illustrates the view of the cleaning tool 200 from the perspective of the arrows marked A in FIG. 8. A hollow path 901 which runs along the length of the cleaning tool 200 is shown. Further, it can be seen from FIG. 9 that each jet port 204 is connected to the hollow path 901. Additionally, regarding the position of the jet ports 204 relative to each other, it can be seen from FIG. 9 that, viewing the cleaning tool 200 from this bottom end 202 perspective, each jet port 204 is substantially distanced at a 90 degree angle from each other along the periphery of the cleaning tool 200.

Figure 10A:
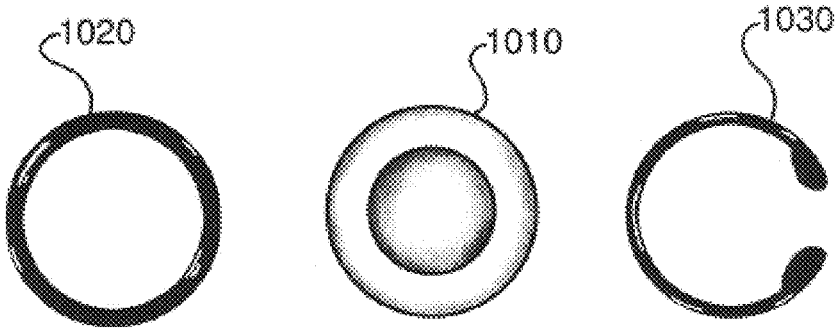
FIGS. 10A–10B illustrate a jet port, an O-ring and a snap ring for use with the cavitation and cleaning tool 200 of FIG. 2 in accordance with one embodiment of the present invention.
Figure 10B:
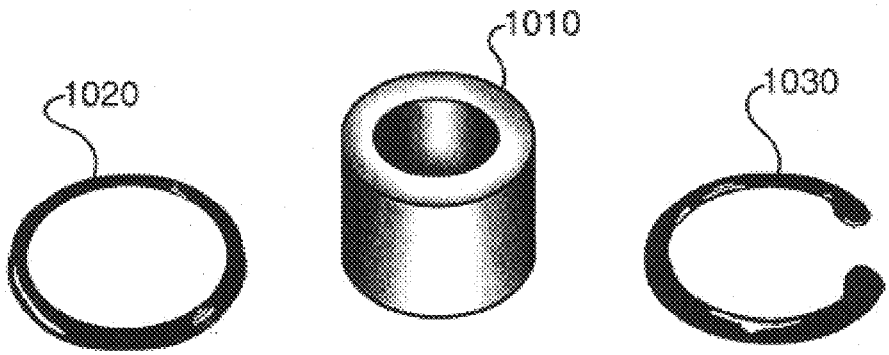

FIG. 10A–10B illustrate a jet module 1010, an O-ring 1020 and a snap ring 1030 for use with the cavitation and cleaning tool 200 of FIG. 2 in accordance with one embodiment of the present invention. As shown, the jet module 1010 is substantially cylindrical in shape with a hollow cavity running through the center of the body. In one embodiment, when inserted, the jet module 1010 is configured to fit within the one inch jet port 204 and rest on the jet port ledge 803 (FIG. 8) within the jet port 204. Moreover, the O-ring 1020 is configured to fit around the outer circular periphery of the jet module 1010 such that, when the jet module 1010 is inserted into the jet port 204, the mounted O-ring 1020 fits into the O-ring slot 802 shown in FIG. 8. Additionally, in one embodiment, the snap ring 1030 fits into the snap ring slot 802 shown in FIG. 8 to maintain the jet module 1010 within the jet port 204 and to keep it from blowing out when the combination of water, air and drilling foam is pumped down the cleaning tool 200 during operation.

The jet module 1010 in one embodiment is one inch in length and is configured to fit into the jet port 204. Alternatively, the jet module 1010 can be configured with different sizes depending upon the application and the requirement for the particular operations. Furthermore, with the jet port ledge 803 at one end and the snap ring 1030 at the other end, the jet module 1010 is securely positioned within the jet port 204 during operation.

Figure 11:
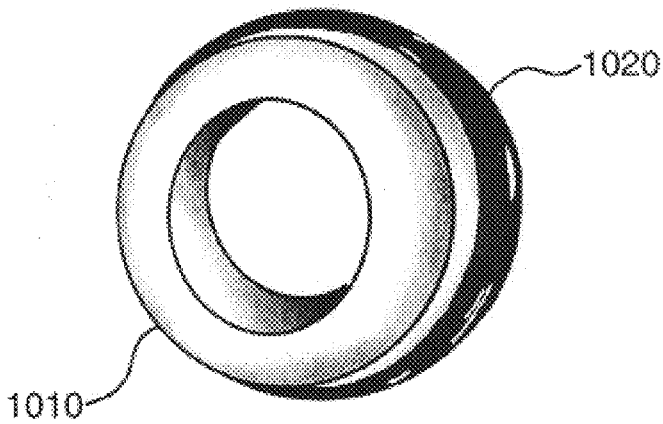
FIG. 11 illustrates a perspective view of the jet port with the O-ring attached thereto for use with the cavitation and cleaning tool 200 of FIG. 2 in accordance with one embodiment of the present invention.

FIG. 11 illustrates a perspective view of the jet module 1010 with the O-ring 1020 mounted thereto for use with the cavitation and cleaning tool 200 of FIG. 2 in accordance with one embodiment of the present invention. As can be seen from this figure, the O-ring 1020 is snugly fit around the outer circumference of the jet module 1010 such that it provides a tight seal between the other surface of the jet module 1010 and the inner walls of the jet port 204. In this manner, during operation, the jet module 1010 can be securely positioned within the jet port 204.

Figure 12:
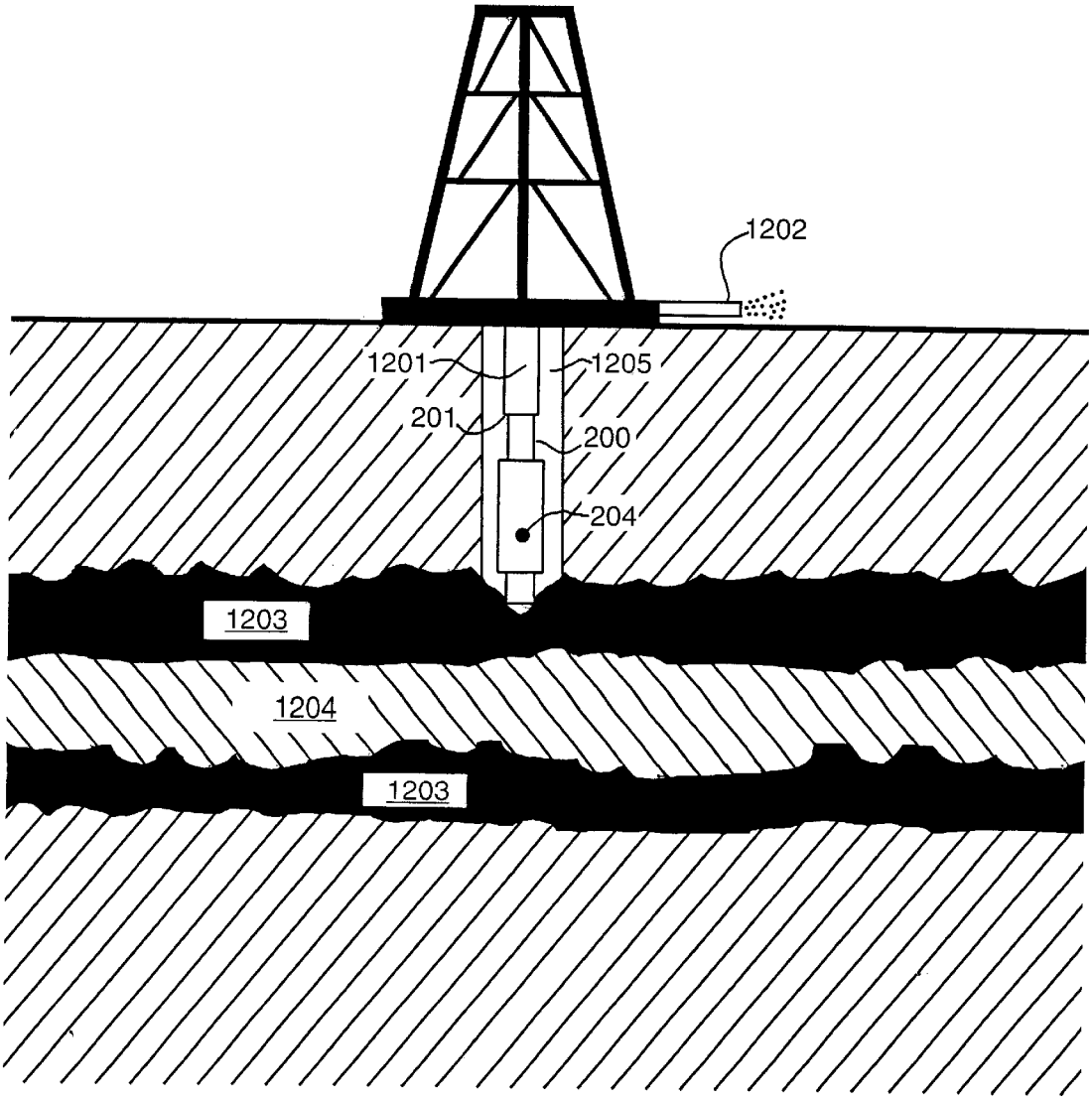
FIG. 12 illustrates a cross-sectional view of the cavitation and cleaning tool 200 of FIG. 2 in operation in a well in accordance with one embodiment of the present invention.

FIG. 12 illustrates the cavitation and cleaning tool 200 of FIG. 2 in operation in a well in accordance with one embodiment of the present invention. As shown, the cavitation and cleaning tool 200 is attached at its top end 201 to a pipe 1201 which is connected to a water pump (not shown) and an air compressor (not shown) to pump into the pipe 1201, a combination of air, water and drilling foam. Also shown in FIG. 10 is a flow line 1202 which is connected to the well casing 1205 to provide an out flow channel for debris and material forced out of the well hole during the operation of the cavitation and cleaning tool 200. Layers 1203 shown in FIG. 12 are coal layers, while layer 1204 is another typical formation such as benite and so on commonly encountered during cleaning and flushing out coal wells.

In operation, as mentioned above, a combination of air, water and liquid drilling foam is pumped into the pipe 1201. The outflow of this combined air, water and drilling foam is then forced out through the jet ports 204 of the cavitation and cleaning tool 200 by the pump pressure, effectively cutting into the coal layer 1203. Additionally, the excess debris and other undesirable material, during the cleaning and well-over operation using the cavitation and cleaning tool 200, are forced out of the well casing 1205 by the pump pressure through the flow line 1202 to be discarded.

As discussed above, the cavitation and cleaning tool in accordance with the present invention is provided with four ports on its body set at a 90 degree angle around the outer circumference of the substantially cylindrical tool body to achieve a full 360 degree placement. Moreover, in accordance with the present invention, the size of the ports provided on the body of the cavitation and cleaning tool can be modified from ⅞th of an inch to 10/32nd of an inch, depending on the depth of the hole where the cavitation and cleaning tool is to be used. Once in the well, the cavitation and cleaning tool of the present invention can be operated using a pump attached at the other end of a conventional drill pipe coupled to the tool, such that air, water and liquid drilling foam are pumped into the drill pipe down to the tool and are forced out, by the pressure, through the plurality of ports on the cavitation and cleaning tool. The forced air and water pumped through the ports of the tool from the drill pipe allows the tool to cut the coal out and make a cavity, while the mixture of the forced drilling foam and water simultaneously cleans the hole during the operation of the cavitation and cleaning tool.

Moreover, the cavitation and cleaning tool in accordance with the present invention is provided with a bit screw attached to the body of the tool at the bottom end. Similar to the threads at the top end of the tool body, the threads on the inner surface of the bottom end of the tool body are, in one embodiment, a 3.5 inch thread configured for a bit screw to be attached onto the bottom end of the tool body. Within the scope of the present invention, however, the sizes of the bit that can be attached to the tool body can vary depending upon availability and user's specification. Indeed, the tool body in accordance with one embodiment of the present invention is configured to adaptively couple to different sized bits so long as the bits can be securely connected onto the bottom end of the tool body.

As a numerical example, the cost of using the cavitation and cleaning tool of the present invention can be approximately estimated as follows. The cost of using the cavitation and cleaning tool at $105 rig time for the trip in, cost of the tool itself at $450 per day, added to the rig time for the trip out at $105 adds to approximately $660.00. Furthermore, since the cavitation and cleaning tool of the present invention does not include any blades, no additional cost and time is necessary to get the blades closed in the event that the blades do not close, for example, as may be the case in using a conventional under-reamer. Indeed, the use of an under-reamer is unnecessary with the cavitation and cleaning tool of the present invention.

As discussed above, the cavitation and cleaning tool of the present invention is configured to open the hole in the well and clean the well, keeping the fine coal in a turbulent motion such that the fine coal are circulated out of the well, thus resulting in less operational complication such as when the fine coal finds its way into the pump. As can be seen, the work-over cost can be eliminated and less time need be spent on cleaning out the well on completion as compared with the conventional approach using the under-reamer. Furthermore, since the cavitation and cleaning tool of the present invention is provided in a substantially single, integrated body, there is less likelihood of a portion of the tool being damaged and rendering the tool inoperable.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. A cavitation and cleaning tool, comprising:

a smooth elongated body having a first end, a second end and an outer surface, a hollow channel running between said first and second ends defining an inner surface of said body, said body including a plurality of ports positioned at a predetermined distance from each other on said body, each of said ports connected to said hollow channel, wherein when pressure is applied at said first end of said body in said channel, each of said ports configured to pass the content of said channel through said each port in a radial direction substantially perpendicular to said outer surface of said body, each of said plurality of ports is positioned substantially equidistant from each other at approximately at 90 degrees, a predetermined portion of said first and second ends of said hollow channel being threaded.

2. The tool of claim 1 wherein said body and said hollow channel are substantially cylindrically shaped.

3. The tool of claim 2 wherein said channel defines a substantially circular openings at said respective first and second ends of said body, each of said substantially circular openings having a diameter of approximately 4.5 inches.

4. The tool of claim 2 wherein each of said ports has a substantially cylindrical port channel each connected to said hollow channel of said body for passing said content therethrough.

5. The tool of claim 4 wherein each of said port channel has approximately a one-inch diameter.

6. The tool of claim 1 wherein each of said plurality of ports is positioned substantially equidistant from each other at approximately a 90 degree angle.

7. The tool of claim 1 wherein a predetermined portion of said inner surface of said body at said first and second ends are each threaded.

8. The tool of claim 7 wherein said threaded predetermined portions are 3½ inches each in length along the length of said inner surface of said body.

9. The tool of claim 1 wherein said content includes a combination of water, air and drilling foam.

10. The tool of claim 1 wherein when said pressure is applied at said first end of said body in said channel, said body is configured to rotate while passing the content of said channel through each of said plurality of ports.

11. The tool of claim 1 further including a plurality of jet modules, each jet module configured to fit within a respective port.

12. The tool of claim 11 wherein each of said plurality of jet modules are secured within said respective ports.

13. A method of providing a cavitation and cleaning tool, comprising the steps of:

providing an elongated body having a first end, a second end and an outer surface, a hollow channel running between said first and second ends defining an inner surface of said body;

providing a plurality of ports is positioned substantially equidistant from each other at approximately at 90 degrees on said body, each of said ports connected to said hollow channel; and applying a pressure at said first end of said body in said channel to pass the content of said channel through said each port in a radial direction substantially perpendicular to said outer surface of said body.

14. The method of claim 13 wherein said body and said hollow channel are substantially cylindrically shaped.

15. The method of claim 14 wherein said channel defines a substantially circular openings at said respective first and second ends of said body, each of said substantially circular openings having a diameter of approximately 4.5 inches.

16. The method of claim 14 wherein each of said ports has a substantially cylindrical port channel each connected to said hollow channel of said body for passing said content therethrough.

17. The method of claim 13 further including the step of threading a predetermined portion of said inner surface of said body at said first and second ends.

18. The method of claim 17 wherein said threaded predetermined portions are 3½ inches each in length along the length of said inner surface of said body.

19. The method of claim 13 further including the step of rotating said body and passing the content of said channel through each of said plurality of ports.

20. The method of claim 13 further including the step of securing a jet module in each respective port.

* * * * *